US007679577B2

(12) United States Patent
Sotoudeh et al.

(10) Patent No.: US 7,679,577 B2
(45) Date of Patent: Mar. 16, 2010

(54) USE OF AMC MATERIALS IN RELATION TO ANTENNAS OF A PORTABLE COMMUNICATION DEVICE

(75) Inventors: Omid Sotoudeh, Vasby (SE); Sören Karlsson, Väsby (SE)

(73) Assignee: Sony Ericsson Mobile Communications AB, Lund (SE)

( * ) Notice: Subject to any disclaimer, the term of this patent is extended or adjusted under 35 U.S.C. 154(b) by 0 days.

(21) Appl. No.: 11/423,196

(22) Filed: Jun. 9, 2006

(65) Prior Publication Data

US 2007/0285318 A1 Dec. 13, 2007

(51) Int. Cl.
*H01Q 15/02* (2006.01)
*H01Q 1/24* (2006.01)

(52) U.S. Cl. ..... 343/909; 343/702

(58) Field of Classification Search ..... 343/800, 343/702, 909

See application file for complete search history.

(56) References Cited

U.S. PATENT DOCUMENTS

| | | | | |
|---|---|---|---|---|
| 6,287,505 | B1 | 9/2001 | Kaitani | |
| 2003/0231142 | A1* | 12/2003 | McKinzie et al. | 343/909 |
| 2004/0160367 | A1 | 8/2004 | Mendolia et al. | |
| 2004/0160370 | A1 | 8/2004 | Ghosh et al. | |
| 2004/0263420 | A1* | 12/2004 | Werner et al. | 343/909 |
| 2005/0057420 | A1 | 3/2005 | Lin et al. | |
| 2006/0092079 | A1 | 5/2006 | De Rochemont | |

FOREIGN PATENT DOCUMENTS

WO 94/13029 A 6/1994

OTHER PUBLICATIONS

International Search Report received in corresponding PCT Application No. PCT/EP2006/069184, mailed on Mar. 14, 2007, 4 pages.

Daniel Sievenpiper et al., "High-Impedance Electromagnetic Surfaces with a Forbidden Frequency Band", in IEEE Transactions on Microwave Theory and Techniques, vol. 47, No. 11, Nov. 1999, pp. 2059-2074.

Alexandros P. Feresidis et al. "Artificial Magnetic Conductor Surfaces and Their Application to Low-Profile High-Gain Planar Antennas", in IEEE Transactions on Antennas and Propagation, vol. 53, No. 1, Jan. 2005, pp. 209-215.

(Continued)

*Primary Examiner*—Douglas W Owens
*Assistant Examiner*—Robert Karacsony
(74) *Attorney, Agent, or Firm*—Harrity & Harrity, LLP

(57) ABSTRACT

A portable communication device comprises a first set of layers providing different circuits, and a second set of layers comprising an antenna layer including all antennas and a grounding layer for all antennas. The grounding layer comprises an AMC material structure facing the antenna layer. The antennas are grouped according to operational frequency range, where each group covers a separate frequency range. The AMC material structure is also divided into sections, where each section faces a group of antennas and has a high surface impedance for the frequency range of this group. There is also a casing surrounding elements of the device including the antenna and grounding layer, where one side of the casing is provided with a strip of AMC material having a high surface impedance for an operational frequency range of at least one antenna.

17 Claims, 3 Drawing Sheets

OTHER PUBLICATIONS

George Gousettis et al., "Tailoring the AMC and EBG Characteristics of Periodic Metallic Arrays Printed on Grounded Dielectric Substrate", in IEEE Transactions on Antennas and Propagation, vol. 54, No. 1, Jan. 2006, pp. 82-89.

Romulo F. Jimenez Broas et al. "A High-Impedance Ground Plane Applied to a Cellphone Handset Geometry", in IEEE Transactions on Microwave Theory and Techniques, vol. 49, No. 7, Jul. 2001, pp. 1262-1265.

* cited by examiner

USE OF AMC MATERIALS IN RELATION TO ANTENNAS OF A PORTABLE COMMUNICATION DEVICE

TECHNICAL FIELD OF THE INVENTION

The present invention relates to the field of antennas and more particularly to antenna arrangements for provision in portable communication devices as well as such portable communication devices.

DESCRIPTION OF RELATED ART

There is a trend within the field of portable communicating devices, and especially within the field of cellular phones to have the main communication antenna built in the phone itself. The phones are also becoming smaller and smaller, with a need to use the space of the phone as effectively as possible. At the same time the phones have more and more functions and features and therefore also more components are provided in them. There are also more and more antennas in the phone related to this added functionality. Due to this fact, there is a need to make antennas smaller and provide them closer to each other. However, when this is done, the performance of the antennas is degraded and they also disturb each other.

There has in recent years been made research in the field of so called AMC (Artificial Magnetic Conductor) materials for use in relation to antennas. An AMC material is a metallic electromagnetic structure that has a high surface impedance. It is implemented through the use of a two-dimensional lattice structure of metal plates being connected to a solid ground layer via vertical conducting vias. Such a structure does not support propagating surface waves for a certain frequency band. This type of structure is for instance described by Sievenpiper et al. in "High-Impedance Electromagnetic Surfaces with a Forbidden Frequency Band", in IEEE Transactions on Microwave Theory and Techniques, Vol. 47, No. 11, November 1999.

These types of surfaces are also called EBG (Electromagnetic Band GAP) surfaces and PGB (Photonic Band Gap) surfaces.

The evolvement of these new materials is interesting because they allow a considerable reduction of the profile of an antenna. Investigations in this direction have for instance been made by Alexandros P. Feresidis et al. in "Artificial Magnetic Conductor Surfaces and Their Application to Low-Profile High-Gain Planar Antennas", in IEEE Transactions on Antennas and Propagation, Vol. 53, No. 1, January 2005.

How to design such a material with regard to a frequency band is furthermore described by George Gousettis et al. in "Tailoring the AMC and EBG Characteristics of Periodic Metallic Arrays Printed on Grounded Dielectric Substrate", in IEEE Transactions on Antennas and Propagation, Vol. 54, No. 1, January 2006.

However most of the literature is directed to antennas for use in cellular base stations and not towards use in portable communication devices and cellular phones and the problems associated with these types of devices.

The use of such a material in a cordless phone have however been described by Romulo F. Jimenez Broas et al. in "A High-Impedance Ground Plane Applied to a Cellphone Handset Geometry", in IEEE Transactions on Microwave Theory and Techniques, Vol. 49, No. 7, July 2001. In a handset described in this document a part of the ordinary circuit board is provided with an AMC structure and the document thus suggests placing an antenna side by side with other components of such a cordless hand set.

In view of what has been described above there is therefore a need for further advantageous uses of an AMC material in relation to a portable communication device in order to among other things reduce the size, simplify production of a portable communication device, limit influences of adjacent antennas on each other as well as for influencing the directivity of antennas.

SUMMARY OF THE INVENTION

The present invention is generally directed towards providing new uses of an AMC material in relation to a portable communication device and antennas in such a portable communication device.

An antenna arrangement is provided for a portable communication device that enables the provision of a small sized portable communication device with a low amount of electromagnetic interference from antennas on other electrical components of the portable communication device.

According to a first aspect, an antenna arrangement is provided in a portable communication device. The device has a first set of joined material layers defining a circuit board and ground. The antenna arrangement includes:

a second set of joined material layers comprising an antenna layer including antennas for the device, and a grounding layer for antennas of the antenna layer, wherein the grounding layer comprises an Artificial Magnetic Conductor (AMC) material structure facing the antenna layer.

A second aspect is directed towards an antenna arrangement including the features of the first aspect, further comprising dielectric material between the antennas and the AMC material structure.

A third aspect is directed towards an antenna arrangement including the features of the first aspect, wherein the antenna layer is divided into different sections, where each section is designed for a separate frequency range and the AMC material structure is divided into sections corresponding to the sections of the antenna layer, where each AMC material structure section facing an antenna layer section is designed to have a high surface impedance for the frequency range of the corresponding antenna layer section.

A fourth aspect is directed towards an antenna arrangement including the features of the third aspect, wherein at least one of the AMC material structure sections further comprises at least one island occupying an area that is aligned with and surrounds an antenna in the corresponding antenna layer section, said island being designed to have a high surface impedance for the frequency range of said antenna layer section and being surrounded by AMC material having a high surface impedance for the frequency range of another antenna layer section.

A fifth aspect is directed towards an antenna arrangement including the features of the fourth aspect, wherein said island is designed to have a high surface impedance only for the frequency range of the antenna surrounded by the island.

Another aspect is to provide a portable communication device that may be of a small size and where there is a low amount of electromagnetic interference from antennas on other electrical components.

According to a sixth aspect, a portable communication device includes:

a first set of joined material layers providing a circuit board and ground; and a second set of joined material layers comprising an antenna layer including antennas of the device, and a grounding layer for the antennas of the antenna layer, wherein the grounding layer comprises an AMC material structure facing the antenna layer.

A seventh aspect is directed towards a portable communication device including the features of the sixth aspect, further comprising dielectric material between the antennas and the AMC material structure.

An eighth aspect is directed towards a portable communication device including the features of the sixth aspect, wherein the first and second set of layers are separated from each other by an isolating material.

A ninth aspect is directed towards a portable communication device including the features of the sixth aspect, wherein the antenna layer is divided into different sections, where each section is designed for a separate frequency range and the AMC material structure is divided into sections, where each AMC material structure section facing an antenna layer section is designed to have a high surface impedance for the frequency range of the corresponding antenna layer section.

A tenth aspect is directed towards a portable communication device including the features of the ninth aspect, wherein at least one section of the AMC material structure further comprises at least one island occupying an area that is aligned with and surrounds an antenna in the corresponding antenna layer section, said island being designed to have a high surface impedance for the frequency range of said antenna layer section and being surrounded by AMC material having a high surface impedance for the frequency range of another antenna layer section.

An eleventh aspect is directed towards a portable communication device including the features of the tenth aspect, wherein said island is being designed to have a high surface impedance only for the frequency range of the antenna.

A twelfth aspect is directed towards a portable communication device including the features of the sixth aspect, further comprising a casing surrounding the first and second set of joined material layers, wherein at least one side of the casing is provided with at least one strip of AMC material designed to have a high surface impedance for the frequency range of at least one antenna of the antenna layer.

A thirteenth aspect is directed towards a portable communication device including the features of the twelfth aspect, wherein said strip is provided on a side of the casing that is parallel to the main radiation direction of said antenna.

A fourteenth aspect is directed towards a portable communication device including the features of the sixth aspect, wherein it is a cellular phone.

Another object is to provide an antenna arrangement that provides a filtering effect through increased isolation between two or several antennas.

According to a fifteenth aspect, this object is achieved by an antenna arrangement for provision in a portable communication device comprising:

a plurality of antennas provided above a grounding layer and in groups according to operational frequency, where each group covers a separate frequency range, wherein the grounding layer comprises an AMC material structure facing the antennas, the AMC material structure being divided into sections, where each AMC material structure section faces a group of antennas and is designed to have a high surface impedance for the frequency range of this group.

A sixteenth aspect is directed towards an antenna arrangement including the features of the fifteenth aspect, wherein at least one section of the AMC material structure further comprises at least one island occupying an area that is aligned with and surrounds one of the antennas in the corresponding group, said island being designed to have a high surface impedance for the frequency range of this group and being surrounded by AMC material having a high surface impedance for the frequency range of another group.

A seventeenth aspect is directed towards an antenna arrangement including the features of the sixteenth aspect, wherein said island is being designed to have a high surface impedance only for the frequency range of the antenna.

Another object is to provide a portable communication device that provides a filtering effect through increased isolation between two or several antennas.

According to an eighteenth aspect, this object is achieved by a portable communication device comprising:

a number of antennas provided in groups according to operational frequency range above a grounding layer, where each group covers a separate frequency range, wherein the grounding layer comprises an AMC material structure facing the antennas, the AMC material structure being divided into sections, where each AMC material structure section faces a group of antennas and is designed to have a high surface impedance for the frequency range of this group.

A nineteenth aspect is directed towards a portable communication device including the features of the eighteenth aspect, wherein at least one section of the AMC material structure further comprises at least one island occupying an area that is aligned with and surrounds one of the antennas, said island being designed to have a high surface impedance for the frequency range of the corresponding group and being surrounded by AMC material having a high surface impedance for the frequency range of another group.

A twentieth aspect is directed towards a portable communication device including the features of the nineteenth aspect, wherein said island is being designed to have a high surface impedance only for the frequency range of the antenna.

A twenty-first aspect is directed towards a portable communication device including the features of the eighteenth aspect, further comprising a casing surrounding elements of the device including antennas and the set of grounding layers, wherein at least one side of the casing is provided with at least one strip of AMC material designed to have a high surface impedance for the frequency range of at least one antenna.

A twenty-second aspect is directed towards a portable communication device including the features of the twenty-first aspect, wherein said strip is provided on a side of the casing that is parallel to the main radiation direction of said antenna.

A twenty-third aspect is directed towards a portable communication device including the features of the eighteenth aspect, wherein it is a cellular phone.

Yet another object is to provide a portable communication device that reduces the back lobe radiation of at least one antenna in the portable communication device.

According to a twenty-fourth aspect, this object is achieved by a portable communication device comprising:

at least one antenna designed for operation in at least one frequency range and being provided above a grounding layer, and a casing surrounding elements of the device including said antenna and grounding layer, wherein at least one side of the casing is provided with at least one strip of AMC material designed to have a high surface impedance for an operational frequency range of at least one antenna A twenty-fifth aspect is directed towards a portable communication device including the features of the twenty-fourth aspect, wherein said strip is provided on a side of the casing that is parallel to the main radiation direction of said antenna.

A twenty-sixth aspect is directed towards a portable communication device including the features of the twenty-fourth aspect, wherein it is a cellular phone.

In some aspects described above, the second set of layers may, because of their arrangement, be totally isolated from the first set of layers. By providing these two separate sets in this way a portable communication device that is very easy to manufacture is also possible to provide. The two sets may be produced separately using standard multilayer PCB production techniques. The two sets may then be joined together in the plant where the portable communication device is assembled.

This means that the assembling of a portable communication device may be very fast. The provision of separate sets based on AMC materials has another advantage. It leads to a more compact portable communication device structure that allows the provision of slimmer portable communication devices. It also enables the reduction of electromagnetic interference between antennas and other portable communication device circuitry because of the complete separation of antennas from the rest of the portable communication device circuitry.

Additionally, aspects described herein allow the lowering of antenna profile. It also provides a filtering effect in that the influence of antennas within one section on the antennas on another section is lowered. The coupling between these antennas is thus reduced. This has the further advantage of allowing the different antennas to be placed closer together, which allows the provision of a smaller portable communication device.

It should be emphasized that the term "comprises/comprising" when used in this specification is taken to specify the presence of stated features, integers, steps or components, but does not preclude the presence or addition of one or more other features, integers, steps, components or groups thereof.

BRIEF DESCRIPTION OF THE DRAWINGS

The present invention will now be described in more detail in relation to the enclosed drawings, in which.

DETAILED DESCRIPTION OF EMBODIMENTS

Figure 1:
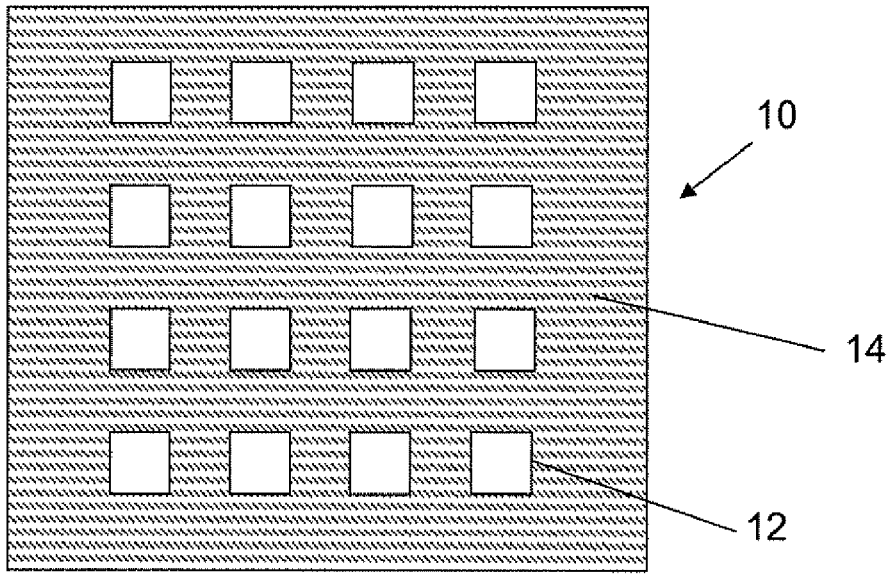
FIG. 1 shows a top view of one exemplary lattice structure for an AMC material being used in a portable communication device, FIGS. 2A and 2B schematically show side views of the structure of the AMC material in order to be provided for antennas in different frequency bands.
Figure 2A:
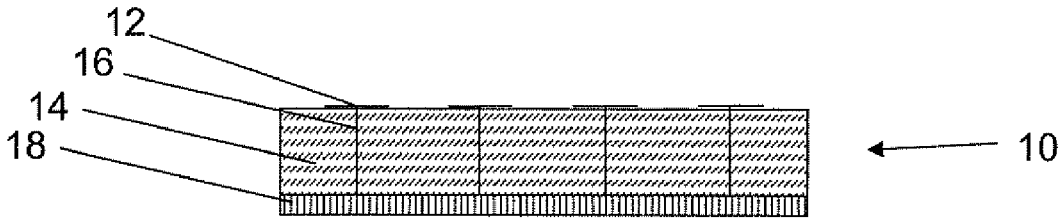

FIG. 1 schematically shows a top view of an AMC (Artificial Magnetic Conductor) material structure, while FIG. 2A shows a side view of such a structure. An AMC material 10 includes a number of patches 12 of electrically conducting material organized in a symmetrical structure that is often a lattice structure. In FIG. 1 each patch 12 is shown as being quadratic. This is just one example of such a patch shape. The patches can in fact have any suitable shape, like for instance in the form of concentric rings or have pentagonal, hexagonal or octagonal shape. It should also be realized that the lattice structure can be varied in many ways. The patches may also have different size and shape between layers or within each layer to allow wideband or multiband characteristics. Each such patch 12 is furthermore connected to an underlying smooth conducting layer 18 with a vertical conducting via 16. In FIG. 2A an AMC material structure comprising a single layer of patches 12 is shown, which may be suitable for use in relation to antennas operating at a high frequency band. The patches 12 are normally provided on a substrate 14 of dielectric material, through which the vias 16 run to the smooth conducting layer 18. When the AMC material structure is used as ground for an antenna, this smooth conducting layer is connected to ground. Such a structure 10 does not support propagating surface waves in the frequency band for which it is designed, since it possesses a high surface impedance in this band. These types of surfaces are also called EBG (Electromagnetic Band Gap) surfaces or PGB (Photonic Band Gap) surfaces. The system of patches and via's which together generate the band gaps for surface waves at the designed frequencies, will also generate an effective capacitance and inductance. This capacitance and inductance helps to reduce the design frequency of the combined system of the antenna and the AMC surface relative to the antenna and patch sizes. As a consequence of this the profile of antennas may be reduced.

Figure 2B:
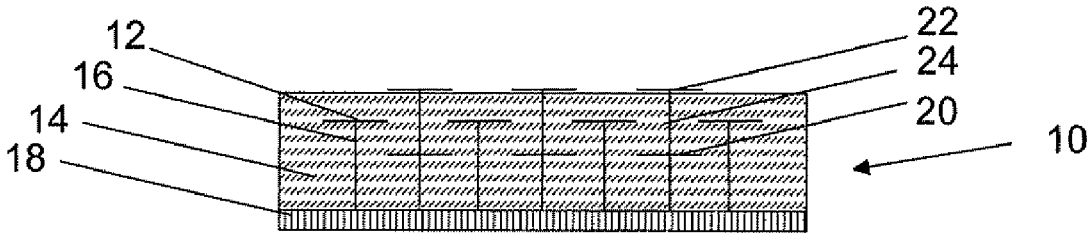

The present technology of mobile phones or handsets has reached a certain standard of dimensions of these devises and they are also in the future becoming even smaller. For these dimensions the structure of FIG. 2A is most suitable for high frequencies, normally in the order of several GHz. In order to be be able to use such a structure at lower frequencies, like for instance GSM frequencies at around 800 MHz, the structure has to varied. FIG. 2B shows a principle in which the material may be varied for obtaining the above mentioned properties in lower bands. In FIG. 2B an AMC material layer comprising three layers of patches 12, 20 and 20 are shown. These patch layers are provided vertically stacked onto each other, where the lattice structure of intermediate layers have been shifted in relation to each other so that the patches of one layer are provided in gaps between patches of a neighbouring layer. It should here be realised that patches of neighbouring layers may also overlap each other. As can be seen in FIG. 2B the patches 20 in a bottom layer of patches having a certain lattice structure are connected to the smooth conducting layer 18 via vias 24, followed by an intermediate layer of patches 12 with the same lattice structure but shifted in a horizontal direction. The patches 12 of this intermediate layer are connected to the ground layer 18 using vias 16. There is finally a top layer of patches 22 with the same lattice structure and having patches 22 that are aligned with the patches 20 of the bottom layer. Because of this the vias 24 of the bottom layer of patches continue through the patches 20 up to the patches 22 of the top layer. Substrate material 14 is provided between the top layer of patches 22 and the ground layer 18 and thus surrounds the bottom and intermediate layers of patches 20 and 12. By using this technique, where it is possible to add several layers of patches on top of each other, and varying the sizes and shapes of the patches, it is possible to obtain a lower frequency band where the structure may be used. It is also possible to vary the lattice structure and distances between patches in the lattice structure.

It should be noted that the patches 20 and 22 do not need to be aligned and the same dielectric material is not necessarily needed to be used for the entire structure. In the structure of FIG. 2B it is for instance possible to use a first dielectric material between the smooth conducting layer and the bottom layer of patches, a second dielectric material between the bottom layer of patches and the intermediate layer of patches and a third dielectric material between the top layer of patches and the intermediate layer of patches. However the description above with this alignment and the same material used in the structure will lead to reduction of the complexity from a manufacturing point of view.

It is furthermore possible that patches within the same layer of patches have different shapes as well as to have different shapes of patches in different layers. It is also possible to have parasitic patches in one or more of the layers of patches, i.e. patches without connection to the smooth conducting layer The structures and the basic principles of stacking patch layers are known and are described in more detail in, for example, Sievenpiper et al. in "High-Impedance Electromagnetic Surfaces with a Forbidden Frequency Band", in IEEE Transactions on Microwave Theory and Techniques, Vol. 47, No. 11, November 1999.

These types of AMC materials thus allow the profile of antennas to be lowered, which is of interest with regard to portable communication devices and then especially cellular phones, where there are constant efforts being made to reduce the size of the phone together with an effort to provide more and more functionality inside a phone.

Figure 3:
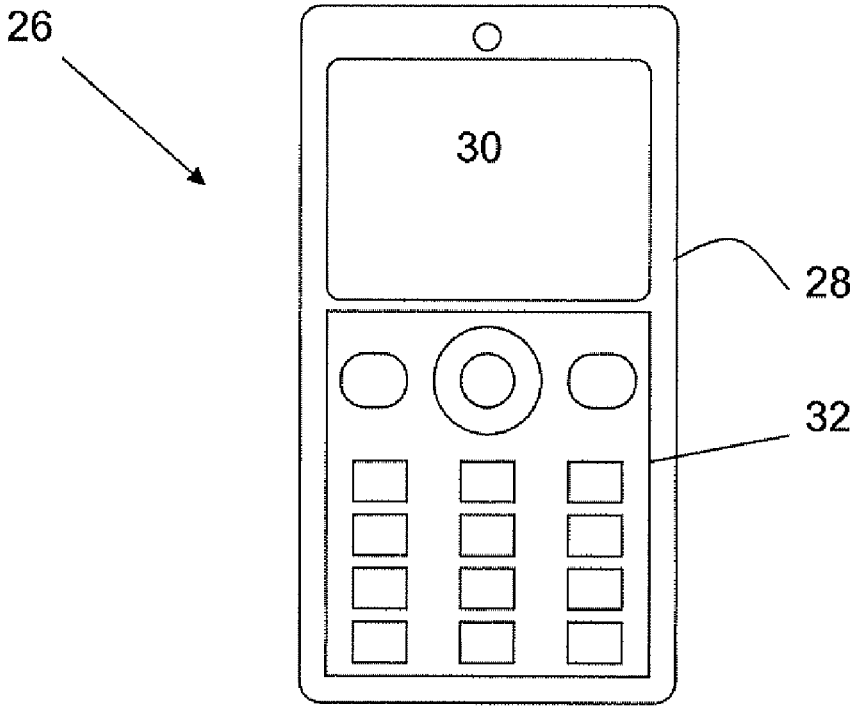
FIG. 3 shows a front view of a portable communication device in the form of a cellular phone.

FIG. 3 therefore shows a top view of a portable communication device 26 in the form a cellular phone. The different functional units of the phone 26 are provided inside a casing 28, which on a front side is provided with openings through which a display 30 and a keypad 32 are provided. The front side of the casing 28 is bounded by a left long side, a right long side, a top short side and a bottom short side all provided at essentially right angles to the front side. Opposite of the front side there is provided a back side (not shown) that is in the same way bounded by the left long side, the right long side, the top short side and the bottom short side. In this way, the casing forms a box within which the different components and units of the phone 26 are provided. The different antennas of the phone 26 are here provided inside the box near the back side of the phone.

Figure 4:
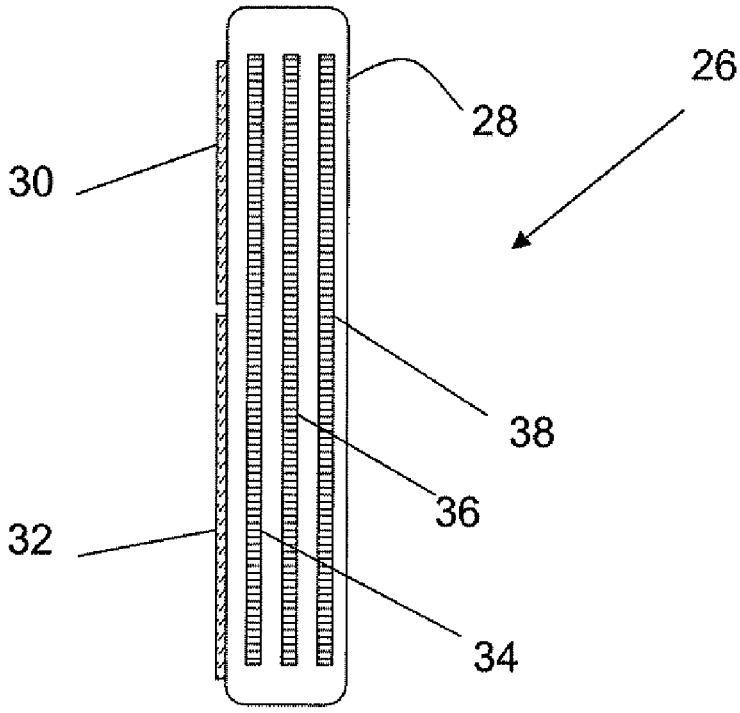
FIG. 4 shows a side view of the phone in FIG. 3.

FIG. 4 shows a side view of the casing 28 as viewed from the right long side of FIG. 1. Here it can be seen that the display 30 and keypad 32 protrude out from the front side. In the figure there is furthermore provided a first strip of AMC material 34, a second strip of AMC material 36 and a third strip of AMC material 38 on this right long side. These strips have each been designed for different frequency ranges according to the principles mentioned above. The functioning of these strips will be described later. For now, it is sufficient to mention that one or more of the left long side, the top short side and the bottom short side may also be provided with one or more such strip.

Figure 5:
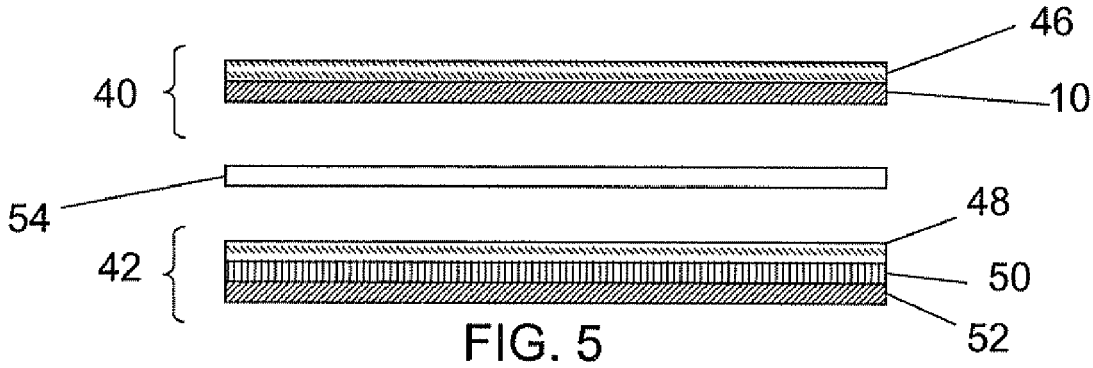
FIG. 5 shows a side view of a first and a second set of layers provided in a cellular phone according to a second exemplary implementation, FIG. 6 schematically shows a top view of an antenna layer over an AMC material structure according to a third exemplary implementation, and FIG. 7 schematically shows a top view of a part of an antenna section over a corresponding section of an AMC material structure in a refinement of the third exemplary implementation.

FIG. 5 schematically shows a side view of a first 42 and a second 40 joined set of material layers according to an exemplary implementation for construction inside the casing of the phone of FIGS. 3 and 4.

In the first set of layers 42 at the bottom of FIG. 5, there is provided a first component provision layer 52 comprising a number of components. This layer is intended to face the front side of the casing in FIG. 3 and thus the display and keypad are to be connected to this layer. On top of this first component provision layer there is provide an intermediate layer 50, which among other things provides a ground plane for components in the first set of material layers 42. Finally the first set of material layers includes a second component provision layer 48 for providing further components of the phone. This first set of layers 42 is thus provided as a unitary structure and may comprise a circuit board, ground and circuits for the main functions of the phone. It does however not have any antennas or the ground for antennas.

In the second set of material layers 40 at the top of FIG. 5 there is provided an antenna layer 46. This antenna layer 46 is thus intended to face the bottom side of the casing. This layer includes all the antennas of the phone, which may include antennas for cellular phone communication, radio and television antennas as well as short range wireless communication and WLAN antennas. The antenna layer 46 may be provided in the form of pieces of sheet metal provided on a substrate. It can also be provided through etching or other suitable placing of conductive plates and strips on a substrate, which substrate preferably is of a dielectric material. The substrate is in turn provided on top of an AMC material structure 10 and is designed for the different frequencies of the different antennas. The smooth conducting layer of the AMC material structure 10 may be grounded. The AMC material structure 10 therefore forms a grounding layer. How the AMC material structure is provided will be described in more detail later.

Between the two sets of layers 40 and 42, where each layer within a set of layers have been joined together, there is provided a separate isolating layer 54 in order to provide electrical isolation between the two sets of layers. It should be realised that this isolating layer 54 may as an alternative, be provided as a part of either the first or the second set of layers.

By providing the first and second set of material layers in this way several advantages are obtained. Because of this arrangement, the second set of layers 40 is isolated from the first set of layers. By providing these two separate sets in this way a phone that is very easy to manufacture is provided. The two sets may be produced separately using standard multilayer PCB production techniques. The two sets and the isolation layer may then be joined together in the plant where the phone is assembled. This means that the assembling of a phone will be very fast. The provision of separate sets based on AMC materials has another advantage. It leads to a more compact phone structure that allows the production of slimmer phones. It also reduces the EMI (Electromagnetic Intereference) between antennas and phone circuitry because of the complete separation of antennas from the rest of the phone circuitry.

It should however be realised that the second set of layers may be provided in other places than facing the bottom side of the casing. It may for instance be provided on the front side, along any of the long or short sides or even in a part of the phone that is attached to the casing, such as in a flip. The second set of layers may also be provided in another type of entity such as in an accessory to be connected to the phone. The second set of layers may furthermore include one or more antennas.

Figure 6:
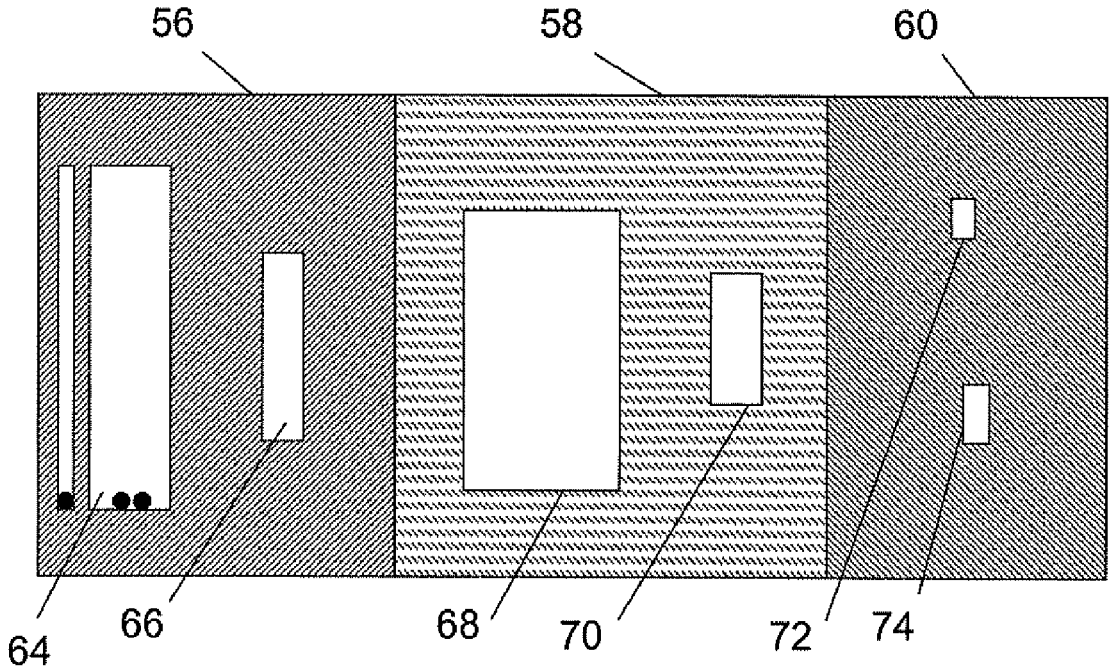

FIG. 6 shows a top view of an AMC material structure with antennas provided on top of it according to another exemplary implementation. This implementation may advantageously be combined with the first implementation in that all antennas are provided in an antenna layer provided above the AMC material structure. However, this second implementation is not limited to being combined with the first implementation. The antennas according to this implementation need for instance not be provided in a layer but can be provided as separate entities over the AMC material structure. The AMC material structure may furthermore according to this implementation not be provided for all the antennas of the phone, but for instance only to a limited number of antennas and then for at least two different antennas. It is however preferred to have all antennas above this AMC material structure. The AMC material structure may here also be a part of an ordinary PCB, for instance an upper part, where the lower part is provided for ordinary electronic components.

In FIG. 6 the AMC material structure has been divided into three different sections 56, 58 and 60, where a first section 56 has been designed according to the principles mentioned above to be effective in a first frequency range that may for instance be a range covering the cellular phone transmission bands. This first range may for instance include different GSM and UMTS communication bands ranging from 850 to 2200 MHz. This first section 56 is to be provided at the top back side of the phone. The second section has been designed to be effective at a second frequency range, for instance a lower range used for television and radio transmission, such as the FM and UHF bands and thus ranging from 87.9 to 700 MHz. The second section 58 is to be provided in the middle of the back side of the phone. The third section 60 has been designed for use in a third frequency range for instance to be used with Bluetooth™ and WLAN ranging from 2 to 11 GHz and may be provided at the bottom back side of the phone. Some frequencies included are 2.4 GHz for Bluetooth™, 2.4/5.6 GHz for WLAN and 3.1-10.6 GHz for UWB antennas. In the case of an antenna layer, also, this has been divided into a corresponding number of sections, where each antenna section is aligned with the corresponding AMC material structure section and includes a group of antennas designed to operate in frequency bands covered by the frequency range for which the AMC material structure section has been designed. This means that an AMC material structure section faces a group of antennas and has a high surface impedance for the frequency range of this group. As can be seen there is a first antenna 64 that is a PIFA antenna with a parasitic element and a second antenna 66 provided above the first section 56, a third and a fourth antenna 68 and 70 provided above the second section 58 and a fifth and a sixth antenna 72 and 74 provided above the third section 60. Here only the first antenna 64 has been shown with an actual exemplary antenna structure, while the others are indicated by boxes. It should be realised that all these antennas can have any suitable structure for being able to communicate in an intended frequency band.

As an example the first antenna 64 is a GSM antenna, while the second antenna 66 is an UMTS antenna. The third antenna 68 may be an FM radio antenna, while the fourth antenna 70 may be a DVBH television antenna. Finally the fifth antenna 72 may be a Bluetooth™ antenna, while the sixth antenna 74 is a WLAN antenna. It should here be realised that the antenna layer might include a GPS antenna and there might furthermore be provided a hole in the structure in order to allow a camera to be placed on the back side of the phone. It should furthermore be realised that more or fewer sections may be provided.

As mentioned above the different AMC material structure sections have been designed to be operative, i.e. have a high surface impedance, at a frequency range covering the bands of the antennas placed above the sections. This means that the sections effectively have different compositions. This also means that the antenna profile may be lowered. An additional advantage is that because these sections have been designed differently there is provided a filtering effect in that the influence of antennas within one section on the antennas on another section is lowered. Therefore, there is an isolation between the antennas of the different sections and coupling is thus reduced. This has the further advantage of allowing the different antennas to be placed closer together, i.e. closer together in a direction parallel to the plane of the AMC material structure. This also allows the provision of a smaller phone in that the length of for instance the long sides of the phone may be reduced. By providing the different sections beside each other in an intelligent way coupling is further reduced. Sections may be placed so that sections that are designed for neighbouring frequency ranges are separated by a section designed for another range. Thus, in the example of FIG. 6, the second section covers the lowest frequencies and the third section covers the highest frequencies. Since they are placed beside each other the coupling between the antennas of these different sections is low. As an alternative it is possible to place the third section in the middle so that the second and third sections change place with each other in FIG. 6. Naturally also the antennas would then also change place.

It is possible to further limit the coupling between antennas of different sections and even between antennas provided in the same section. This is exemplified by the structure shown in FIG. 7, which shows a top view of the first and second antennas 64 and 66 over the first section 56 of the AMC material structure. It should here be realised that what has been done to the AMC material structure in this first section 56 may be done also to the second and third sections. However, in order to keep this description simple only this first section 56 is described.

Figure 7:
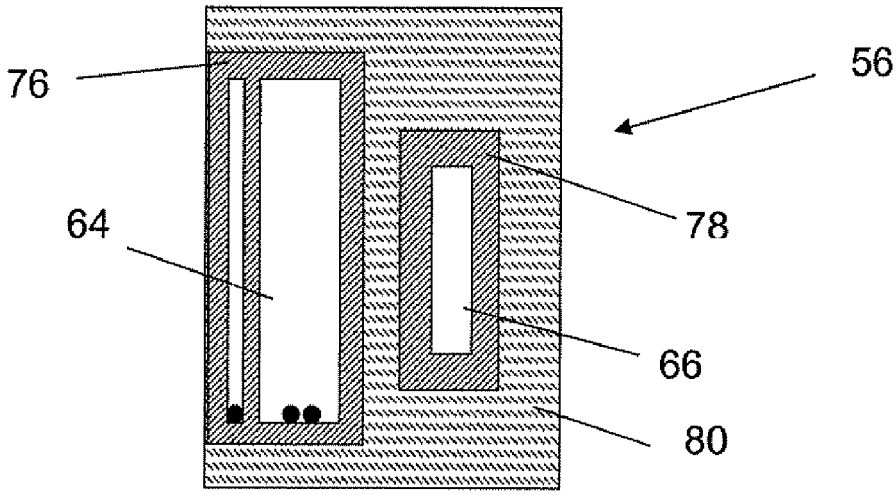

In FIG. 7, the first section has a first island 76 occupying an area that is aligned with and surrounds the first antenna 64 and a second island 78 occupying an area that is aligned with and surrounds the second antenna 66. Here the AMC structure of both the first and second islands 76 and 78 are designed to have a high surface impedance for the whole range of frequencies of the first section 56 and are surrounded by AMC material structure that has been designed to have a high surface impedance for the frequencies of another section (in this case the third section). This even further reduces the coupling between antennas of the different sections as well as of the antennas within the first section. It is furthermore possible to even further lower the coupling by making the first island have a high surface impedance only for the frequency range of the first antenna 64 and the second island to only have a high surface impedance for the frequency range of the second antenna 66. Thus it is possible to design an island after the frequency band of the specific antenna it surrounds.

This thus provides even lower coupling between antennas and thus allows even further size reductions.

Finally a third exemplary implementation will now be described with reference once again being made to FIG. 4 as well as to FIG. 6. This implementation may advantageously be combined with the first and/or the second exemplary implementation in that all antennas are provided in an antenna layer provided above the AMC material layer where the antennas are optionally provided in different sections. However, this exemplary implementation is not limited to being combined with the first and second implementations. Antennas according to this third exemplary implementation are actually not limited to antennas provided together with AMC material, but may be provided in relation to antennas provided in the phone in a conventional way, i.e. together with antennas using the ordinary ground plane in the first set of layers of FIG. 5 as the antenna ground plane.

The casing of the phone is here provided with a first strip 34 of AMC material, a second strip 36 of AMC material and a third strip 38 of AMC material on the left long side of the casing 28. It should here be realised that the strips might be provided also on the other long side and/or on one and both of the short sides. Here the first strip 34 has AMC material that is being designed after the operational frequency range of the antennas of the first section in FIG. 6, the second strip 36 has AMC material that is designed for the frequency range of the antennas of the second section in FIG. 6, while the third strip 38 has AMC material that is designed for the frequency range of the antennas in the third section 60. The strips here each have a structure based on the teachings made in relation to FIGS. 1 and 2.

The antennas 64, 66, 68, 70, 72 and 74 all have main lobes essentially provided straight out from the back side of the phone, i.e. in a direction to the right in FIG. 4. This is thus the main radiation direction of these antennas. As can be seen, these strips are thus placed on a side of the phone that is parallel to this main radiation direction. Each strip is thus parallel to the main radiation direction of each antenna for which it is provided.

With this placing of the strips the back and side lobe radiation of the antennas is reduced. Since this back lobe radiation is made in a direction where there is little or bad contact with base stations, this means that the back lobe radiation is essentially wasted. By reducing this back and side lobe radiation better directivity is obtained and thus the power of the phone is used in a more efficient manner. Since an antenna performs better because of these measures a lower output power can be used, which thus saves power. Since a phone is battery powered, this is an important issue.

It should here be realised that that the frequency range of a strip may be limited to a smaller band than to the band of the section discussed above. It may for instance be limited to the frequency range of a single antenna. For this reason it should be realised that more or fewer such strips may be provided. It should furthermore be realised that for some antennas or some frequency ranges there may be no strip at all. Thus the present invention is only to be limited by the following claims.

The invention claimed is:

1. An antenna arrangement provided in a portable communication device, the antenna arrangement comprising:

a first set of joined material layers defining a circuit board and ground;

a second set of joined material layers comprising an antenna layer that includes all antennas for the device, and a common grounding layer for all the antennas of the antenna layer, where the grounding layer comprises an Artificial Magnetic Conductor (AMC) material structure configured to face the antenna layer, where the antenna layer is divided into different sections, with each section configured for a separate frequency range, where the AMC material structure is divided into sections corresponding to the sections of the antenna layer, where each AMC material structure section facing a corresponding antenna layer section is configured to have a high surface impedance for the frequency range of the corresponding antenna layer section, and where at least one of the AMC material structure sections further comprises at least one island occupying an area that is aligned with and surrounds an antenna in the corresponding antenna layer section, said island being designed to have a high surface impedance for the frequency range of said antenna layer section and being surrounded by AMC material having a high surface impedance for the frequency range of another antenna layer section.

2. The antenna arrangement according to claim 1, where the second set of joined material layers further includes dielectric material between the antennas and the AMC material structure.

3. The antenna arrangement according to 1, where said island is designed to have a high surface impedance only for the frequency range of the antenna surrounded by the island.

4. A portable communication device comprising:

a first set of joined material layers providing a circuit board and ground; and, a second set of joined material layers comprising an antenna layer including all antennas of the device, and a common grounding layer for the antennas of the antenna layer, where the common grounding layer comprises an Artificial Magnetic Conductor (AMC) material structure facing the antenna layer, where the antenna layer is divided into different sections, with each section configured for a separate frequency range, where the AMC material structure is divided into sections corresponding to the sections of the antenna layer, where each AMC material structure section facing a corresponding antenna layer section is configured to have a high surface impedance for the frequency range of the corresponding antenna layer section, and where at least one of the AMC material structure sections further comprises at least one island occupying an area that is aligned with and surrounds an antenna in the corresponding antenna layer section, said island being designed to have a high surface impedance for the frequency range of said antenna layer section and being surrounded by AMC material having a high surface impedance for the frequency range of another antenna layer section.

5. The portable communication device according to claim 4, further comprising dielectric material between the antennas and the AMC material structure.

6. The portable communication device according to claim 4, where the first and second set of layers are separated from each other by an isolating material.

7. The portable communication device according to claim 4, where said island is designed to have a high surface impedance only for the frequency range of the antenna surrounded by the island.

8. The portable communication device according to claim 4, further comprising a casing surrounding the first and second set of joined material layers, where at least one side of the casing is provided with at least one strip of AMC material designed to have a high surface impedance for the frequency range of at least one antenna of the antenna layer.

9. The portable communication device according to claim 8, where said strip is provided on a side of the casing that is parallel to the main radiation direction of said at least one antenna.

10. The portable communication device according to claim 4, where the device is a cellular phone.

11. An antenna arrangement for provision in a portable communication device, the antenna arrangement comprising:

a plurality of antennas, all antennas of the plurality of antennas provided above a common grounding layer and in groups according to operational frequency ranges of the plurality of antennas, where each group covers a separate frequency range, where the common grounding layer comprises an Artificial Magnetic Conductor (AMC) material structure facing the plurality of antennas, the AMC material structure being divided into sections, where each AMC material structure section faces the group of antennas and is designed to have a high surface impedance for the frequency range of the group of antennas, and where at least one section of the AMC material structure further comprises at least one island occupying an area that is aligned with and surrounds an antenna in a corresponding group, said island being designed to have a high surface impedance for the frequency range of the corresponding group and being surrounded by AMC material having a high surface impedance for the frequency range of another group.

12. The antenna arrangement according to claim 11, where said island is designed to have a high surface impedance only for the frequency range of the one of the antennas in the corresponding group.

13. A portable communication device comprising:

a plurality of antennas provided above a common ground layer and in groups according to operational frequency range of the antenna, where each group covers a separate frequency range, where the common grounding layer comprises an Artificial Magnetic Conductor (AMC) material structure facing the antennas, the AMC material structure being divided into sections, where each AMC material structure section faces the group of antennas and is designed to have a high surface impedance for the frequency range of the group of antennas, and where at least one section of the AMC material structure further comprises at least one island occupying an area that is aligned with and surrounds an antenna in a corresponding group, said island being designed to have a high surface impedance for the frequency range of the corresponding group and being surrounded by AMC material having a high surface impedance for the frequency range of another group.

14. The portable communication device according to claim 13, where said island is designed to have a high surface impedance only for the frequency range of the one of the antennas in the corresponding group.

15. The portable communication device according to claim 13, further comprising a casing surrounding the plurality of antennas and the grounding layers, where at least one side of the casing is provided with at least one strip of AMC material designed to have a high surface impedance for the frequency range of at least one antenna.

16. The portable communication device according to claim 15, where said strip is provided on a side of the casing that is parallel to the main radiation direction of said at least one antenna.

17. The portable communication device according to claim 13, where the device is a cellular phone.

* * * * *